US010494708B2

(12) United States Patent
Buckley et al.

(10) Patent No.: US 10,494,708 B2
(45) Date of Patent: Dec. 3, 2019

(54) CARBURIZATION OF STEEL COMPONENTS

(71) Applicant: SIKORSKY AIRCRAFT CORPORATION, Stratford, CT (US)

(72) Inventors: Jonathan Buckley, Stratford, CT (US); Bruce D. Hansen, Shelton, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 192 days.

(21) Appl. No.: 15/561,281

(22) PCT Filed: Mar. 29, 2016

(86) PCT No.: PCT/US2016/024616

§ 371 (c)(1),
(2) Date: Sep. 25, 2017

(87) PCT Pub. No.: WO2016/160751

PCT Pub. Date: Oct. 6, 2016

(65) Prior Publication Data

US 2018/0119266 A1 May 3, 2018

Related U.S. Application Data

(60) Provisional application No. 62/142,179, filed on Apr. 2, 2015.

(51) Int. Cl.

| | |
|---|---|
| ***C23C 8/22*** | (2006.01) |
| ***C23C 8/80*** | (2006.01) |
| ***C22C 38/40*** | (2006.01) |
| ***C22C 38/10*** | (2006.01) |
| ***C22C 38/12*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |

(52) U.S. Cl.

CPC ..... *C23C 8/22* (2013.01); *C22C 38/10* (2013.01); *C22C 38/105* (2013.01); *C22C 38/12* (2013.01); *C22C 38/40* (2013.01); *C22C 38/42* (2013.01); *C22C 38/44* (2013.01); *C22C 38/46* (2013.01); *C22C 38/50* (2013.01); *C23C 8/80* (2013.01)

(58) Field of Classification Search

CPC .. C23C 8/22; C23C 8/80; C22C 38/50; C22C 38/44; C22C 38/46; C22C 38/42

See application file for complete search history.

(56) References Cited

U.S. PATENT DOCUMENTS

| | | | |
|---|---|---|---|
| 7,648,588 | B2 | 1/2010 | Hammond et al. |
| 8,801,872 | B2 | 8/2014 | Wright |
| 2003/0089426 | A1 | 5/2003 | Poor et al. |
| 2005/0133119 | A1 | 6/2005 | Hammond et al. |
| 2005/0133120 | A1 | 6/2005 | Walenta et al. |
| 2008/0145690 | A1 | 6/2008 | Mukherji et al. |
| 2009/0199930 | A1 | 8/2009 | Wright et al. |
| 2009/0223052 | A1 | 9/2009 | Chaudhry et al. |
| 2010/0200122 | A1 | 8/2010 | Qian et al. |
| 2011/0108164 | A1 | 5/2011 | Jain |
| 2012/0018052 | A1 | 1/2012 | Moyer |
| 2012/0111454 | A1 | 5/2012 | Moyer |
| 2013/0228253 | A1 | 9/2013 | Garrison, Jr. |

FOREIGN PATENT DOCUMENTS

| | | | |
|---|---|---|---|
| WO | 2016126456 | A1 | 8/2016 |

OTHER PUBLICATIONS

International Search Report and Written Opinion; Intrernational Application No. PCT/US2016/024616; International Filing Date: Mar. 29, 2016; dated Jun. 30, 2017; 12 Pages.

*Primary Examiner* — Jessee R Roe
(74) *Attorney, Agent, or Firm* — Cantor Colburn LLP

(57) ABSTRACT

A method of carburizing a steel component having a composition of Fe-16.3Co-7.5Ni-3.5Cr-1.75Mo-0.2W-0.11C-0.03Ti-0.02V includes generating a low pressure vacuum in a carburization furnace having the steel component therein, heating the steel component to an optimal carburization temperature while in the low pressure vacuum, performing a boost cycle to introduce carbon rich gas into the carburization furnace while the steel component is at the optimal carburization temperature and in the low pressure vacuum, and performing a diffuse cycle by ceasing introduction of the carbon rich gas into the carburization furnace to allow for diffusion of the carbon into the steel component to occur and while the steel component is at the optimal carburization temperature and in the low pressure vacuum. The boost cycle and the diffuse cycle are repeated to achieve a carbon content at a surface of the steel component of between 0.40 wt. % and 0.55 wt. %.

15 Claims, 7 Drawing Sheets

CARBURIZATION OF STEEL COMPONENTS

CROSS REFERENCE TO RELATED APPLICATIONS

This application is a National Stage application of PCT/US2016/024616, filed Mar. 29, 2016, which claims the benefit of U.S. Provisional Patent Application No. 62/142,179, filed Apr. 2, 2015, both of which are incorporated by reference in their entirety herein.

BACKGROUND

The subject matter disclosed herein generally relates to methods of treating steel components and, more particularly, to a method and process of forming an improved steel component. Embodiments of the present disclosure are directed to steel component treatments and specifically to carburization processes of steel components made from steel having a composition of Fe-16.3Co-7.5Ni-3.5Cr-1.75Mo-0.2W-0.11C-0.03Ti-0.02V.

In the design and manufacture of steel components, and particularly gears, there is often a need to modify properties of the material. It is well recognized that carburizing is a process suited for hardening the surface and sub-surface of the steel component. Carburizing can be broadly considered as either an atmospheric carburization process or a vacuum carburization process. In the vacuum carburization process, the component is heated to an elevated temperature within a carburizing furnace under a vacuum, and a carburizing gas is introduced into the environment so that carbon atoms are diffused into the surface and sub-surface of the steel material. The carbon content in the surface and near sub-surface of the component is increased while the carbon content within the core of the component remains unaltered. The characteristics of the component have thus been modified to provide a hardened outer surface surrounding an interior core.

In response to the continued demand for new goods and services, engineers and scientists are always seeking to enhance products through material selection and/or process development. Stainless steel is widely utilized in many components in a vast array of products. One stainless steel of interest has a composition of Fe-16.3Co-7.5Ni-3.5Cr-1.75Mo-0.2W-0.11C-0.03Ti-0.02V, and one exemplary and available product is made under the trade name, Ferrium® C64™, and produced by QuesTek. As will be appreciated by those of skill in the art, the number preceding the chemicals is the nominal weight percentage, with the balance being iron.

In a carburizing process the time and temperature that the material is subjected to while in the carburizing environment will determine the surface hardness, case depth, hardness profile, and microstructure of the hardened portion of the material.

Gears are used in various industrial and technological applications to permit power transmission from one rotating or translating element to another. Each gear generally includes an array of gear teeth that mesh with the gear teeth of another gear so that the rotation or translation of the first gear can be transmitted to the second gear.

Existing gears may be heavy, and in aircraft applications, the weight of the gears may impact and/or limit the payload capability and/or range of the aircraft. Previous attempts to lighten the weight of gears resulted in gears that were not sufficiently robust to operate under operational conditions. For example, the technique of shot peening has been applied to the surfaces of the gears in order to produce a compressive residual stress layer and further modify the structural properties of the materials that formed the gears.

SUMMARY

According to one embodiment a method of carburizing a steel component having a composition of Fe-16.3Co-7.5Ni-3.5Cr-1.75Mo-0.2W-0.11C-0.03Ti-0.02V is provided. The method includes generating a low pressure vacuum in a carburization furnace having the steel component therein, heating the steel component in the carburization furnace to an optimal carburization temperature while in the low pressure vacuum, performing a boost cycle to introduce carbon rich gas into the carburization furnace while the steel component is at the optimal carburization temperature and in the low pressure vacuum, and after preforming the boost cycle, performing a diffuse cycle by ceasing introduction of the carbon rich gas into the carburization furnace to allow for diffusion of the carbon into the steel component to occur and while the steel component is at the optimal carburization temperature and in the low pressure vacuum. The boost cycle and the diffuse cycle are repeated to achieve a carbon content at a surface of the steel component of between 0.40 wt. % and 0.55 wt. %.

In addition to one or more of the features described above, or as an alternative, further embodiments may include, wherein the optimal carburization temperature is 1830° F. (1000° C.) plus or minus 100° F. (56° C.).

In addition to one or more of the features described above, or as an alternative, further embodiments may include, wherein the boost cycles and the diffuse cycles are repeated to achieve a hardness of HRC 60 (732 Knoop) or greater 0.020 inches (0.051 cm) below the surface of the steel component.

In addition to one or more of the features described above, or as an alternative, further embodiments may include, wherein the boost cycles and the diffuse cycles are repeated to achieve a carbon percent of between 0.15 wt. % and 0.25 wt. % at a depth of between 0.020 inches (0.051 cm) and 0.130 inches (0.330 cm) from the surface.

In addition to one or more of the features described above, or as an alternative, further embodiments may include, wherein the boost cycles and the diffuse cycles are repeated to achieve a hardness of HRC 55 (630 Knoop) at a depth of between 0.020 inches (0.051 cm) and 0.130 inches (0.330 cm) from the surface.

In addition to one or more of the features described above, or as an alternative, further embodiments may include quenching the steel component having a carbon content at the surface of the steel component of between 0.40 wt. % and 0.55 wt. %, cold treating the quenched steel component, and tempering the cold-treated steel component.

In addition to one or more of the features described above, or as an alternative, further embodiments may include, wherein the quenching is performed in the carburization furnace.

In addition to one or more of the features described above, or as an alternative, further embodiments may include, wherein the steel component is a gear.

According to another embodiment, a steel component is provided that is manufactured according to any of the above methods.

According to another embodiment, a steel component is provided. The steel component includes a body formed from steel having a composition of Fe-16.3Co-7.5Ni-3.5Cr-1.75Mo-0.2W-0.11C-0.03Ti-0.02V, the body having a surface, wherein the body is carburized to a carbon content at a surface of the steel component of between 0.40 wt. % and 0.55 wt. %.

In addition to one or more of the features described above, or as an alternative, further embodiments may include, wherein the steel component is carburized at 1830° F. (1000° C.) plus or minus 100° F. (56° C.).

In addition to one or more of the features described above, or as an alternative, further embodiments may include, wherein the steel component has a hardness of HRC 60 (732 Knoop) or greater 0.020 inches (0.051 cm) below the surface of the steel component.

In addition to one or more of the features described above, or as an alternative, further embodiments may include, wherein the steel component has a carbon percent of between 0.15 wt. % and 0.25 wt. % at a depth of between 0.020 inches (0.051 cm) and 0.130 inches (0.330 cm) from the surface.

In addition to one or more of the features described above, or as an alternative, further embodiments may include, wherein the steel component has a hardness of HRC 55 (630 Knoop) at a depth of between 0.020 inches (0.051 cm) and 0.130 inches (0.330 cm) from the surface.

In addition to one or more of the features described above, or as an alternative, further embodiments may include, wherein the steel component is a gear.

Technical effects of embodiments of the present disclosure include a process and associated component formed from steel having a composition of Fe-16.3Co-7.5Ni-3.5Cr-1.75Mo-0.2W-0.11C-0.03Ti-0.02V ("the steel composition"). Further technical effects include carburization processes for treating the steel composition to achieve desired strength and hardness.

BRIEF DESCRIPTION OF THE DRAWINGS

The subject matter is particularly pointed out and distinctly claimed in the claims at the conclusion of the specification. The foregoing and other features and advantages of the present disclosure are apparent from the following detailed description taken in conjunction with the accompanying drawings in which:

DETAILED DESCRIPTION

Steel components typically have high strength, but the high strength may be at the cost of a high weight. Steel components are useful in various operations due to the high strength characteristics, including aircraft applications. In aircraft applications, however, weight is an important consideration. Thus, it is desirable to have components formed from high strength materials, such as steel, while maintaining or achieving the lowest possible weight.

For example, one type of steel component is a transmission gear. In transmission design, such as for aircrafts, transmission weight reduction is of considerable importance. Thus, because the gears inside a transmission are normally the heaviest components in a drive system, reducing gear size and numbers of gears can be useful in reducing transmission weight and volume. Alternatively, forming the gears from lightweight materials that retain high material strength and robustness may provide a solution without the need to change other elements of a transmission system due to changes in size/number of gears, etc., as results from other solutions for weight reduction.

Figure 1:
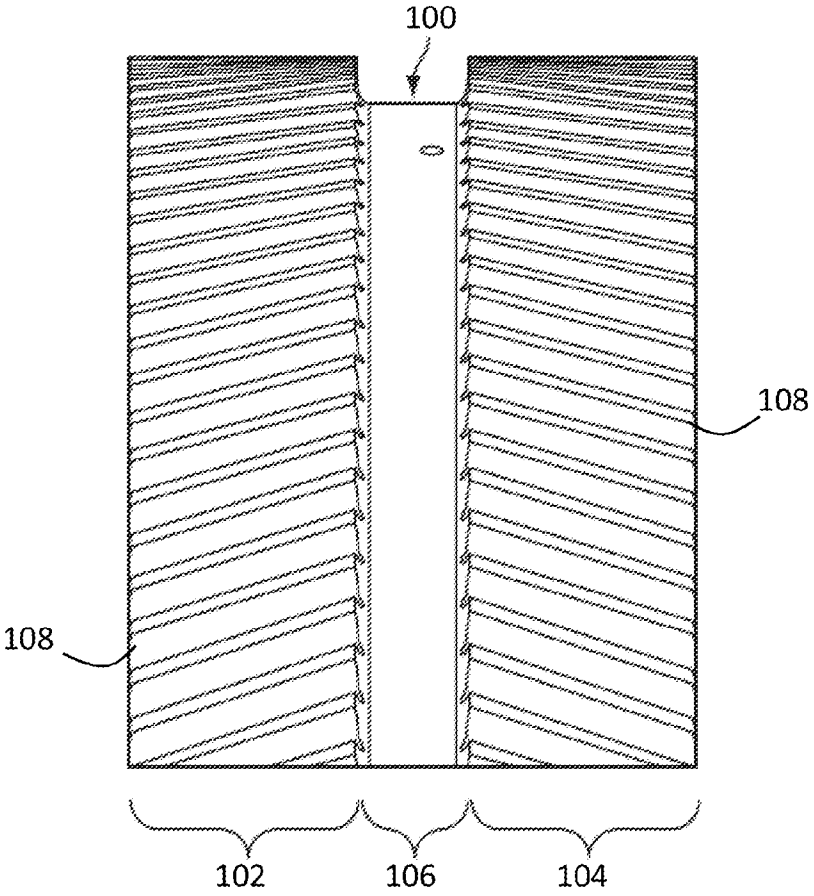
FIG. 1 is a schematic view of a double helical gear with an apex gap, showing an exemplary gear having gear teeth.

With reference to FIG. 1, an exemplary steel component 100, such as a conventional double helical gear, is shown. The steel component 100 of FIG. 1 includes a first side 102 having a helical gear pattern of gear teeth 108, a second side 104 having a helical gear pattern of gear teeth 108 opposite the first side 102, and an apex gap 106 defined axially between the first side 102 and the second side 104. Each of the first side 102 and the second side 104, of the steel component 100, include a plurality of gear teeth 108.

The steel component 100 may require a high strength and hardness due to the forces of operation of a system in which the steel component 100 may be located. For example, as a gear, high strength and hardness is desired on certain areas of the gear, such as on the gear teeth to be able to withstand the forces of operation in a transmission. One method of increase the strength and hardness of a steel component, and particularly gears, is to subject the steel component to carburization processes during the formation, manufacture, and/or preparation of the gear prior to installation into a transmission. However, traditional steel components may be too heavy or may be not strong enough to withstand the forces of operation.

Thus, it is desirable to form steel component 100, such as the gear shown in FIG. 1, out of lightweight components but also retain strong structural properties to operate efficiently and effectively within a transmission, such as within an aircraft transmission. Those of skill in the art will appreciate that the steel component 100 of FIG. 1 is merely an exemplary gear, and other types of components, such as gears, shafts, splines, raceways, etc. may be formed by the processes disclosed herein, without departing from the scope of the present disclosure. For example, the processes disclosed herein may be used for forming straight spur gears, bull gears, bevel gears, input gears, output gears, transfer gears, spur gears, etc. Further, two sets of teeth, as shown in FIG. 1, are not a requirement for the gears formed by the processes described herein. For example, a gear may include a single set of gear teeth and/or the gear teeth may cover an entire periphery surface and/or circumference of the gear. In other embodiments, more than two sets of teeth may be formed by the processes disclosed herein. Further, for example, the shapes of the gear teeth can be varied with some gear teeth being linearly shaped, some being helically shaped, and others being provided as double-helical or herringbone shaped, and still others being provided as arcuate shaped (or C-Gear) gear teeth, and still others being face gears without departing from the scope of the present disclosure.

Existing steel components, especially gears, may be heavy. Heavy gears and other steel components, for example when used in transmissions of aircraft, may limit capability and range of aircraft. However, a steel of a composition of Fe-16.3Co-7.5Ni-3.5Cr-1.75Mo-0.2W-0.11C-0.03Ti-0.02V may be a steel suitable for forming steel components due to high strengths and low relative weight. But, no process was previously published for carburization of a component formed from this steel composition, particularly to form steels sufficient for gears and other steel components in aerospace applications. One exemplary and available steel having a composition of Fe-16.3Co-7.5Ni-3.5Cr-1.75Mo-0.2W-0.11C-0.03Ti-0.02V is produced by QuesTek and available under the trade name Ferrium® C64™, which is specified in AMS 6509. Variations and descriptions of this steel composition are presented in U.S. Pat. No. 8,801,872, entitled "Secondary-hardening Gear Steel," issued on Aug. 12, 2014, and assigned to QuesTek Innovations, LLC, the entirety of which is hereby incorporated by reference, including the variations and compositions described therein. As disclosed herein, a carburization process is described for steel having a composition of Fe-16.3Co-7.5Ni-3.5Cr-1.75Mo-0.2W-0.11C-0.03Ti-0.02V, hereinafter referred to as "the steel composition."

Figure 2:
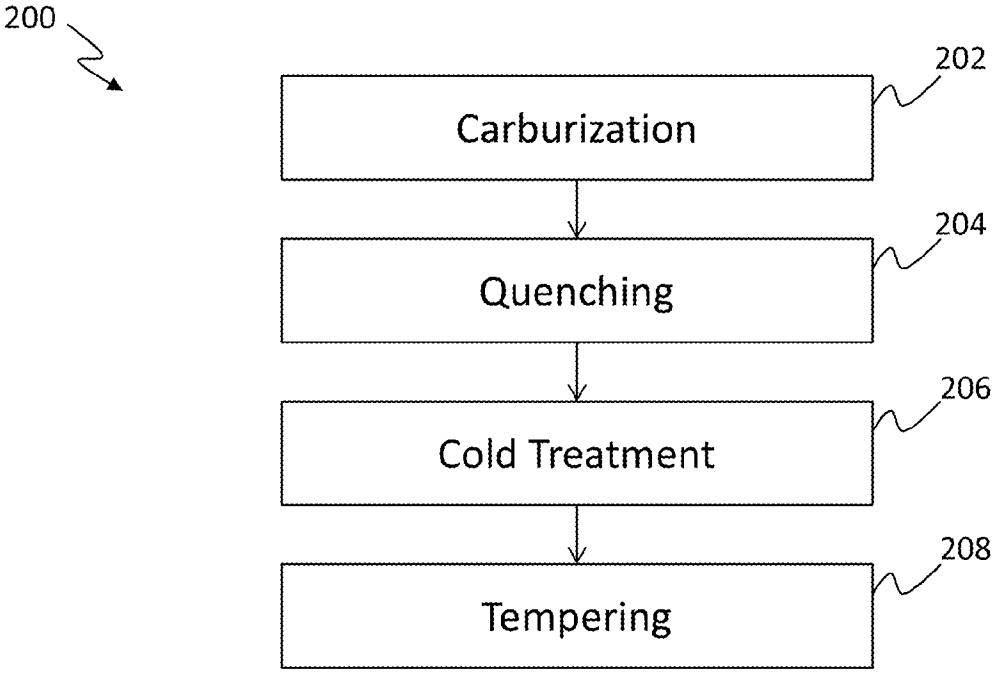
FIG. 2 is an exemplary process of heat treating and forming a steel component in accordance with an exemplary embodiment of the present disclosure.

A carburization-heat treatment process 200, as shown in FIG. 2, may be performed on a fabricated, manufactured, or formed steel component that is composed of a steel having a composition described above. The carburization and heat treatment processes are performed to achieve desired characteristics for the steel component, such as desired case hardness, desired case depth, robustness, case and core strength, microstructure, etc.

At step 202 of process 200, the steel component is carburized, as described in more detail below. The carburization process in accordance with an exemplary embodiment of the present disclosure is described below with respect to FIG. 4 and process 400. Those of skill in the art will appreciate that process 400 may be substituted in place of step 202 of process 200. However, for simplicity and ease of explanation, the detail of the carburization process is described with respect to a separate figure (FIG. 4) below.

Then, a high pressure gas quench may be performed at step 204. In some embodiments, a 1.8 bar or above, high pressure inert gas quench using nitrogen from the carburization temperature to lower the temperature to between room temperature (60° F. (15.6° C.)) and 150° F. (65.6° C.) may be performed. The high pressure gas quenching allows transformation from austenite to martensite microstructure in the steel composition. As will be appreciated by those of skill in the art, oil quenching can be substituted, with consideration and modifications made for additional diffusion time.

After the quenching process 204, a cold treatment may be performed at step 206. For example, in some embodiments, a cold treatment of −110° F. (−78.9° C.) or lower, as low as 0 Kelvin (−459.67° F. (−273.15° C.)), may be performed for one hour minimum, although other lengths of time may be used depending on the configuration and other factors. The cold treatment 206, in some embodiments, may be performed within eight hours of the quenching process 204, although other lengths of time may be used depending on the configuration and other factors.

Finally, tempering may be performed at step 208. In some embodiments, the tempering 208 may be performed at 925° F.±50° F. (496° C.±10° C.) for eight hours, plus or minus two hours. This results in a steel component having desired hardness, strength, and robustness to perform in transmissions, while maintaining a low weight.

Although a specific order and some examples of the process 200 described above is provided, those of skill in the art will appreciate that these are presented merely for exemplary and illustrative purposes. The order, temperatures, and/or times may be varied without departing from the scope of the present disclosure.

The above described process enables a uniform dispersion of fine carbides in a fine grain structure. Further, lath martensite is formed with no greater than twenty percent retained austenite with few to no networked carbide formations on the surface. Furthermore, the steel composition is generated such that it is free of continuous phase grain boundary carbides.

Figure 3:
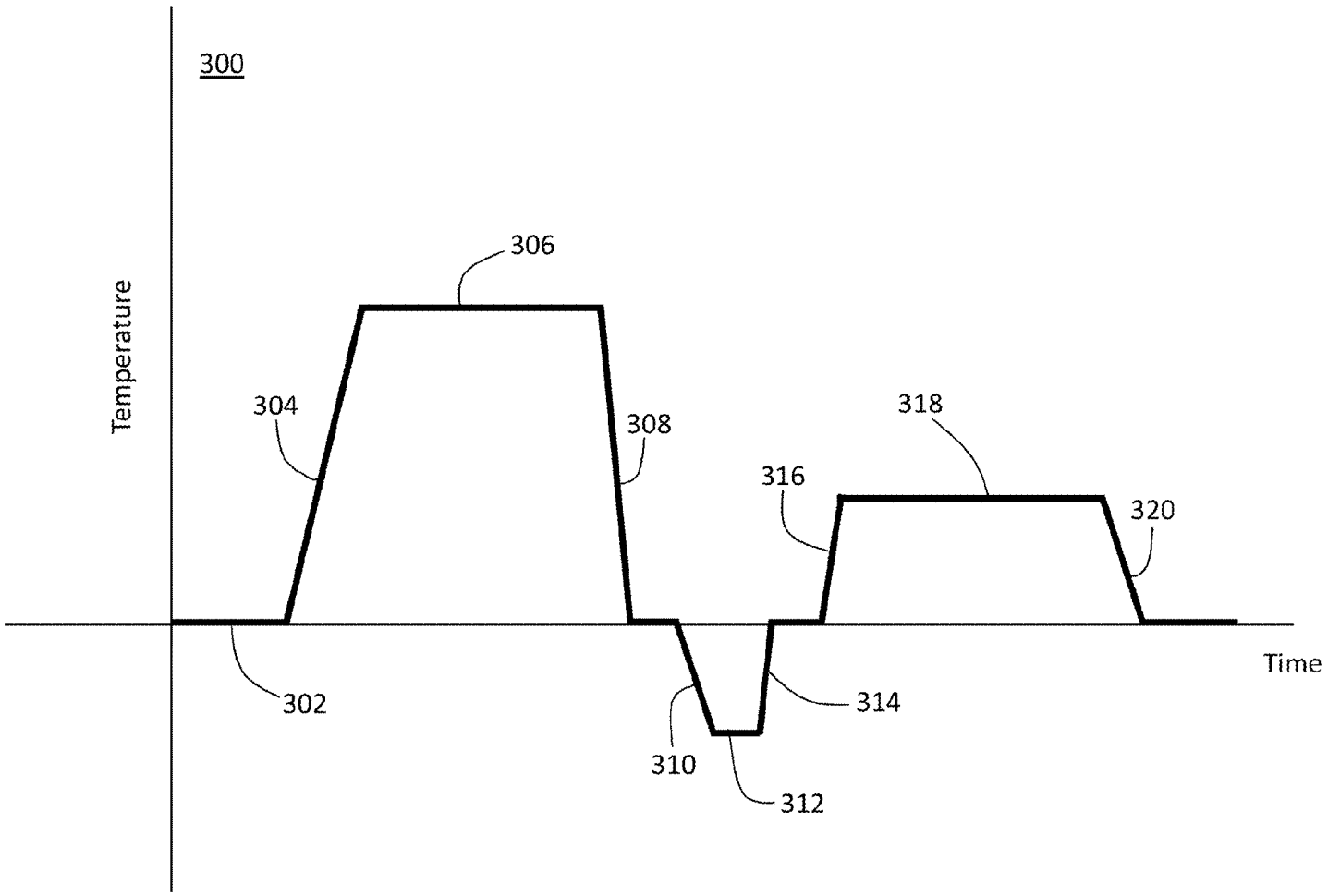
FIG. 3 is an exemplary time-temperature plot of a process in accordance with an exemplary embodiment of the present disclosure.

Turning now to FIG. 3, a time-temperature plot 300 of a heat treat process for carburizing and hardening the steel composition, as depicted by process 200 described in FIG. 2, is shown. At time period 302 a barstock or forging is either ground or machined initially to form a steel component structure, such as a gear. Then at time period 304, the steel component is heated to a carburization temperature, then carburized at time period 306, as described in detail below. For example, in a carburization furnace the temperature is increased to 1830° F.±100° F. (1000° C.±56° C.) during time period 304, then maintains that temperature for the period 306, in which a boost-diffuse cycle is performed, that is, a boost-diffuse cycle is performed when the component or part reaches the carburization temperature. The temperature increase in the furnace from room temperature to the carburizing temperature transforms ferrite to austenite within the steel composition.

Then, at period 308, high pressure gas quenching is performed, as depicted by step 204 of FIG. 2. The gas quenching is performed at the high pressure such that martensite is formed within the steel composition with a portion of the steel remaining as retained austenite in the steel composition. The component is then returned to room temperature after the high pressure gas quench.

At period 310 a deep freeze process is performed, as depicted in the cold treatment of step 206 of FIG. 2. In an exemplary embodiment, the deep freeze may be performed such that a portion of the retained austenite may be transformed to martensite.

The steel component may then be allowed to attain room temperature at period 314. Then, during period 316, the temperature is increased to perform tempering during period 318, as depicted in the tempering step 208 of FIG. 2. The gear is finally cooled to room temperature during period 320.

It will be appreciated by those of skill in the art that FIG. 3 is not to scale with respect to time or temperature, and the time-temperature plot 300 is merely provided for explanatory and illustrative purposes.

As described above, several treatment or processing steps are performed to achieve desired case hardness and case depth consistently while avoiding excess retained austenite and networked/grain boundary carbides. During the carburization process (step 202 of FIG. 2 and/or period 306 of FIG. 3), a boost/diffuse cycle may be performed. During this process, each boost time must be kept to a minimal time while the diffusion time allows the carbon to diffuse into the material. This allows the steel composition to form a layer of carbon deep into the material while preventing a high carbon percentage from forming on the surface of the steel component. By precisely controlling the carbon levels at the surface and within the steel component, a carburized steel component may achieve a desired hardness, robustness, strength, etc. The result is a steel component with carburized areas having hardness values comparable to or higher than other steels traditionally used for aerospace applications.

Figure 4:
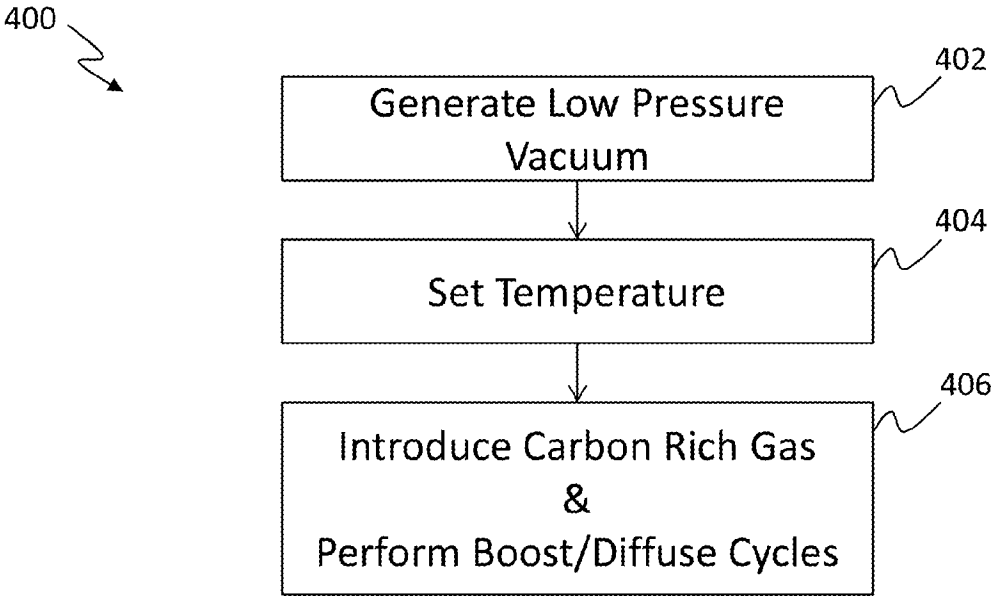
FIG. 4 is an exemplary carburization process in accordance with an exemplary embodiment of the present disclosure.

Turning now to FIG. 4, an exemplary carburization process 400 in accordance with an exemplary embodiment of the present disclosure is shown. A steel of this steel composition is placed in a carburization furnace.

A low pressure vacuum is generated at step 402 in the carburization furnace to avoid potential surface oxidation during the carburization process, for example during step 404, described below.

At step 404 the temperature within the carburization furnace is ramped-up to an optimal carburization temperature.

During the low pressure vacuum carburization process 400, carbon rich gas is introduced into the furnace at step 406. Because of the vacuum in the carburization furnace, the carbon contacts the material surfaces of the steel component and then diffuses into the austenite.

After the furnace has reached the optimal carburization temperature, several boost and diffuse cycles are performed at step 406. The boost cycle is a process of injecting carbon rich gas into the carburization furnace. The diffuse cycle is a period where the injection of carbon rich gas is halted, and the carbon diffuses into the material of the steel component under a vacuum. Each boost time, in some embodiments, may have a short or quick time of less than a minute. During the boost cycle, the carbon concentration at the surface may be above the carbon concentration of the interior target thus enabling carbon diffusion into the interior. Thus, during the boost/diffuse cycles of step 406, the carbon concentration at the surface of the steel component fluctuates, peaking during the boost cycle and then as the carbon absorbs or diffuses into the material the carbon concentration reduces or decreases at the surface.

In an exemplary embodiment of process 400, the target surface carbon content is 0.40-0.55 wt. %. This is configured to achieve a hardness of HRC 60 (732 Knoop) or greater to a depth of 0.020 inches (0.051 cm). The target case depth carbon percent is 0.15-0.25 wt. %, which is defined as having a hardness of HRC 55 (630 Knoop). Thus, a hardness of HRC 55 (630 Knoop) is achieved for depths ranging from 0.020 inches to 0.130 inches (0.051 cm to 0.330 cm). Further, a hardness of HRC 48 (510 Knoop) core hardness is achieved at the core of the material or component.

To achieve the desired carbon percent to appropriate depths, while preventing or minimizing negative effects on the surface, the carbon percent at the surface of the steel component is controlled. In an exemplary embodiment, during the carburization process 400, and particularly during step 406, the process is configured to not allow the carbon percent at the surface of the steel component to attain equilibrium at 0.6 wt. % or higher. This is because large, bulky carbides may form on grain boundaries if the carbon content at the surface of the steel component reaches equilibrium above the carbon wt. % of 0.6. Moreover, if the surface becomes saturated with carbon, subsequent boosts will lose effectiveness, and thus the penetration of carbon may not reach desired depths.

An exemplary embodiment of the vacuum carburizing process 400 and associated boost/diffuse cycles will now be described. A steel component having a composition of Fe-16.3Co-7.5Ni-3.5Cr-1.75Mo-0.2W-0.11C-0.03Ti-0.02V is placed in a carburization furnace capable of having both temperature and pressure controlled therein. The carburization furnace is then evacuated to a sub-atmospheric pressure.

The temperature of the furnace is raised to a desired carburizing temperature by adding heat into the carburizing furnace and the temperature is maintained at the carburizing temperature during the carburizing process. As noted above, in some embodiments, the temperature may be maintained at 1832° F.±100° F. (1000° C.±56° C.)

Thereafter, carburizing gas (carbon rich gas) is admitted, injected, and/or pumped into the carburization furnace for a period of time. As the carburizing gas is admitted into the furnace, a pump is operated periodically to draw a further vacuum within the furnace to perform the boost/diffuse cycles. The drawing of the vacuum alternates for a period of time upon the introduction of carburizing gas into the furnace. Upon the completion of a predetermined time for drawing the vacuum with the pump, the cycle is repeated a plurality of times, depending, for example, upon the desired case depth. Specifically, when the carbon rich gas is introduced, this is a boost period and when the vacuum is drawn the gas is halted, and the carbon is diffused into the steel component during a diffuse period.

In some embodiments, upon the completion of the plurality of boost/diffuse cycles, the process may then include a final diffusion time. In some embodiments, the final diffusion time occurs at the same temperature as the carburization process (boost/diffuse cycles) but without the addition of any further carburizing gas being introduced into the furnace. This final diffusion time may enable the carbon atoms to diffuse further into the steel composition. Upon completion of the carburization process (boost/diffuse cycles) and the optional final diffusion cycle, the steel component is then cooled from the carburizing temperature rapidly by quenching in a quenching media, such as gas at a high pressure. In various embodiments, the quenching media is selected from oil, water, and/or a gas, however other quenching media is possible without departing from the scope of the present disclosure.

Figure 5A:
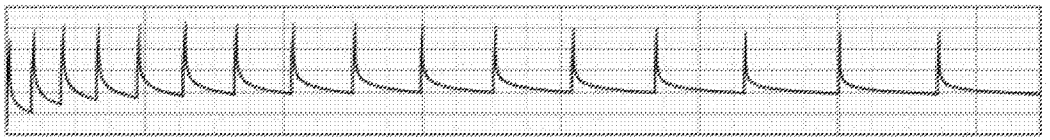
FIG. 5A is a time-carbon percentage plot showing an exemplary boost-diffuse cycle in accordance with an exemplary embodiment of the present disclosure.
Figure 5B:
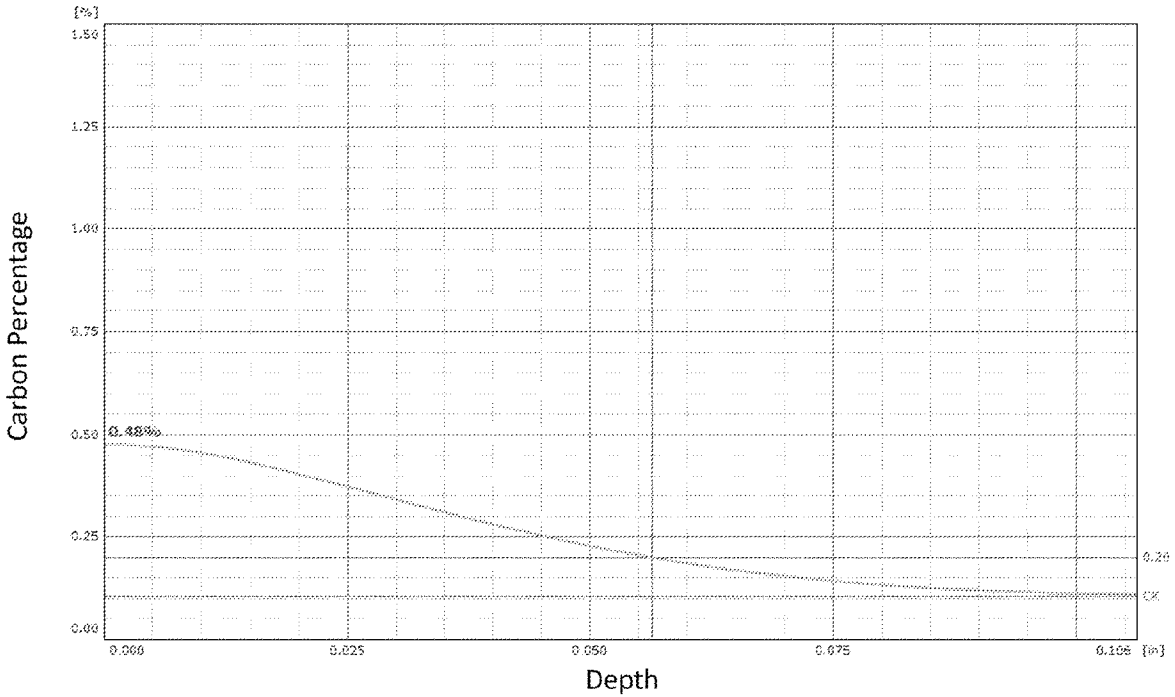
FIG. 5B is a depth-carbon percentage plot showing an exemplary carbon percent in a component formed in accordance with an exemplary embodiment of the present disclosure.

Turning now to FIGS. 5A and 5B, plots representative of the carburization and treatment processes in accordance with exemplary embodiments of the present disclosure are shown. FIG. 5A shows the carbon percent at the surface of the steel component during the boost/diffuse cycles of the carburization process. FIG. 5B illustrates the carbon percent as a function of depth after the carburization and treatment processes are complete.

FIG. 5A is representative of a boost-diffuse cycle process, for example, the cycle of step 406 of FIG. 4. The x-axis of FIG. 5A is time and the y-axis is percentage of carbon present at the surface of the steel component. The plot is representative of the carbon percentages at the surface of the steel component during the carburization process. Throughout the cyclical process as shown in FIG. 5A, the temperature is constant, for example at the optimal carburization temperature.

As illustrated in FIG. 5A, carbon rich gas is pumped into the carburization furnace to achieve a high percentage of carbon at the surface of the steel component, as shown by the peaks. The influx or boost of carbon rich gas is then halted and the percent of carbon at the surface decreases over time. This decrease is due to the diffusion of the carbon into the steel composition. As will be appreciated, because the carburization furnace is drawn to a vacuum, additional carbon is not introduced, and thus the surface carbon is absorbed or diffused into the material of the steel component. After a predetermined period of time, the boost portion of the cycle is repeated, injecting or pumping more carbon rich gas into the carburization furnace. Each boost is represented by a peak or spike as shown in FIG. 5A. After the boost, a diffusion cycle is repeated such that more carbon is diffused into the steel component. As shown in FIG. 5A, the boost cycle may represent a short time period and the diffuse cycles may be relatively longer. In an exemplary embodiment, the boost cycles or periods may be one minute or less and the diffuse cycles or periods may be a minute or greater.

Furthermore, as shown in FIG. 5A, as the boost/diffuse cycles are repeated, the percent of carbon at the surface will reach the desired target carbon percent. It is desirable in some embodiments that the percent of carbon at the surface does not reach greater than a predetermined percent. For example, in some embodiments, the target percent may be the percentage below which large carbides may begin to form, which would be undesirable. As such, when the target carbon percentage, which may be preset or predetermined, is reached at the surface, the boost/diffuse cycles may be stopped.

Turning now to FIG. 5B, a plot of the carbon weight percentage as a function of depth is shown. This plot is representative of an example of steel component as treated with processes 200 and 400, of FIGS. 2 and 4, respectively. The x-axis is depth from the surface of the steel component and the y-axis is the weight percentage of carbon present at the particular depth. As shown, at the surface (depth=0.000 inches) the carbon weight percent is 0.48%. The weight percent then drops as depth increases as a result of the amount of carbon that is absorbed and retained during the carburization, e.g., as detailed with respect to FIG. 4.

Although FIG. 5B shows one specific example, it may be desirable, in some embodiments, that the surface carbon percent be between 0.40 wt. % and 0.55 wt. %. Further, it may be desirable, in some embodiments, for the carbon percent to be between 0.15 wt. % and 0.25 wt. % between 0.020 inches (0.051 cm) and 0.130 inches (0.330 cm) in depth from the surface of the steel component to achieve a desired case depth as defined as HRC 55 (630 Knoop).

Figure 6:
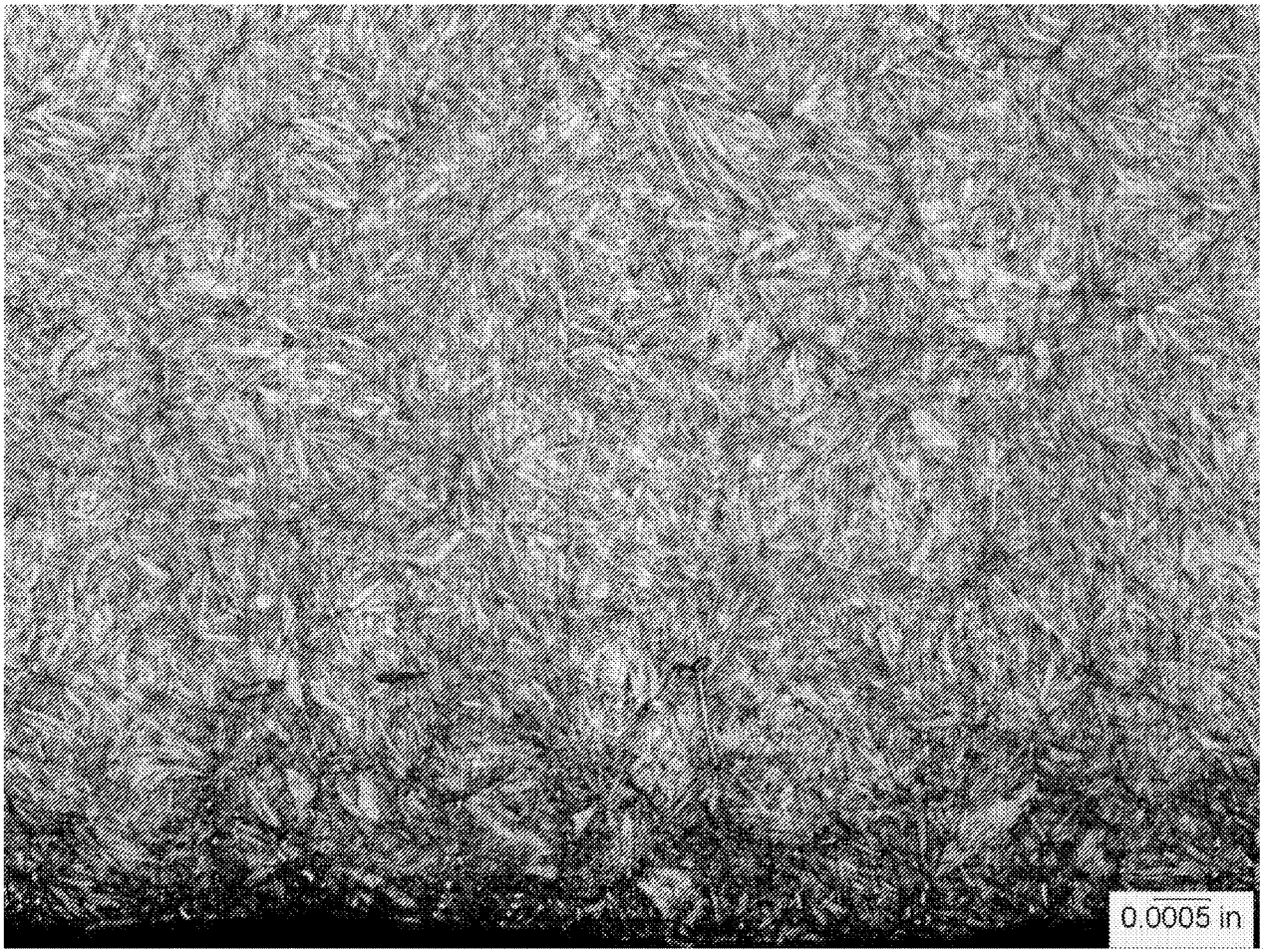
FIG. 6 is a micrograph illustrating a carburized and hardened microstructure of a steel obtained using an exemplary process in accordance with the present disclosure.
Figure 7:
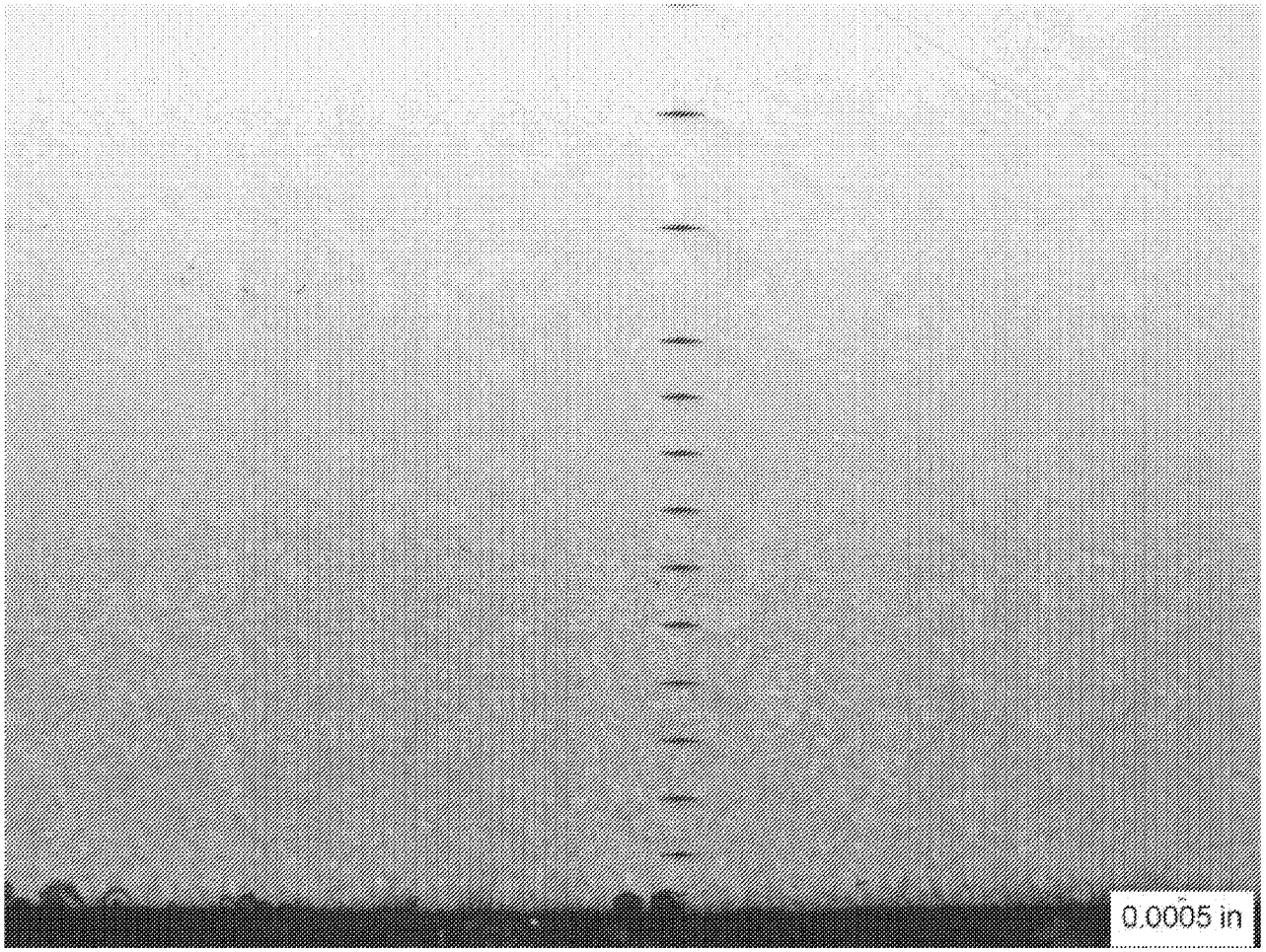
FIG. 7 is a micrograph illustrating a carburized and hardened microstructure of a steel obtained using an exemplary process in accordance with the present disclosure similar to FIG. 6, but zoomed out.

Turning now to FIGS. 6 and 7, micrographs depicting the cross-sectional microstructure of a steel component as carburized and heat treated in accordance with an exemplary embodiment of the present disclosure. As shown there is a relatively uniform distribution of carbon and there are few discrete carbides. Lath martensite is formed with no greater than twenty percent retained austenite with few to no networked carbide formations on the surface. Furthermore, the steep composition is generated such that it is free of continuous phase grain boundary carbides. In FIGS. 6 and 7, the lower right corner of the image shows the scale, with the scale reference bar being equal to 0.0005 inches (0.0013 cm).

Advantageously, embodiments of the present disclosure may provide a carburization process for a steel component having a composition of Fe-16.3Co-7.5Ni-3.5Cr-1.75Mo-0.2W-0.11C-0.03Ti-0.02V such that a suitable component may be produced with high strength and low weight. Specifically, advantageously, employing various embodiments disclosed herein may provide a steel component having a high strength and a low weight such that is ideal for aircraft applications. Further, advantageously, as noted, high hardness and strength may be achieved within a structure formed of steel with the above composition, without the formation of large, bulky carbides which may be detrimental to performance.

While the present disclosure has been described in detail in connection with only a limited number of embodiments, it should be readily understood that the present disclosure is not limited to such disclosed embodiments. Rather, the embodiments of the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although some exemplary depths, times, temperatures, pressures, hardness, etc. are presented herein, those of skill in the art will appreciate that these are merely exemplary and the present disclosure is not intended to be limited thereby. Further, although shown and described primarily with respect to a gear, those of skill in the art will appreciate that the processes described herein may be used for any steel component formed from the steel composition that is desired to have the properties achieved herein. For example, processes disclosed herein may be used for gears, splines, gear teeth, race ways, shafts, etc.

Accordingly, the present disclosure is not to be seen as limited by the foregoing description, but is only limited by the scope of the appended claims.

What is claimed is:

1. A method of carburizing a steel component having a composition of Fe-16.3 wt. % Co-7.5 wt. % Ni-3.5Cr-1.75 wt. % Mo-0.2 wt. % W-0.11 wt. % C-0.03 wt. % Ti-0.02 wt. % V, the method comprising:

generating a low pressure vacuum in a carburization furnace having the steel component therein;

heating the steel component in the carburization furnace to a carburization temperature while in the low pressure vacuum;

performing a boost cycle to introduce carbon rich gas into the carburization furnace while the steel component is at the carburization temperature and in the low pressure vacuum; and after preforming the boost cycle, performing a diffuse cycle by ceasing introduction of the carbon rich gas into the carburization furnace to allow for diffusion of the carbon into the steel component to occur and while the steel component is at the carburization temperature and in the low pressure vacuum, wherein the boost cycle and the diffuse cycle are repeated to achieve a carbon content at a surface of the steel component of between 0.40 wt. % and 0.55 wt. %.

2. The method of claim 1, wherein the carburization temperature is 1830° F. (1000° C.) plus or minus 100° F. (56° C.).

3. The method of claim 1, wherein the boost cycle and the diffuse cycle are repeated to achieve a hardness of HRC 60 (732 Knoop) or greater 0.020 inches (0.051 cm) below the surface of the steel component.

4. The method of claim 1, wherein the boost cycle and the diffuse cycle are repeated to achieve a carbon percent of between 0.15 wt. % and 0.25 wt. % at a depth of between 0.020 inches (0.051 cm) and 0.130 inches (0.330 cm) from the surface.

5. The method of claim 1, wherein the boost cycle and the diffuse cycle are repeated to achieve a hardness of HRC 55 (630 Knoop) at a depth of between 0.020 inches (0.051 cm) and 0.130 inches (0.330 cm) from the surface.

6. The method of claim 1, further comprising:

quenching the steel component having a carbon content at the surface of the steel component of between 0.40 wt. % and 0.55 wt. %;

cold treating the quenched steel component; and tempering the cold-treated steel component.

7. The method of claim 6, wherein the quenching is performed in the carburization furnace.

8. The method of any of claim 1, wherein the steel component is a gear.

9. A steel component manufactured according to the method of claim 1.

10. A steel component comprising:

a body formed from steel having a composition of Fe-16.3 wt. % Co-7.5 wt. % Ni-3.5 wt. % Cr-1.75 wt. % Mo-0.2 wt. % W-0.11 wt. % C-0.03 wt. % Ti-0.02 wt. % V, the body having a surface, wherein the body is carburized to a carbon content at a surface of the steel component of between 0.40 wt. % and 0.55 wt. %.

11. The steel component of claim 10, wherein the steel component is carburized at 1830° F. (1000° C.) plus or minus 100° F. (56° C.).

12. The steel component according to claim 10, wherein the steel component has a hardness of HRC 60 (732 Knoop) or greater 0.020 inches (0.051 cm) below the surface of the steel component.

13. The steel component according to claim 10, wherein the steel component has a carbon percent of between 0.15 wt. % and 0.25 wt. % at a depth of between 0.020 inches (0.051 cm) and 0.130 inches (0.330 cm) from the surface.

14. The steel component according to claim 10, wherein the steel component has a hardness of HRC 55 (630 Knoop) at a depth of between 0.020 inches (0.051 cm) and 0.130 inches (0.330 cm) from the surface.

15. The steel component according to claim 10, wherein the steel component is a gear.

* * * * *